US005392942A

United States Patent [19]

Hanson

[11] Patent Number: 5,392,942

[45] Date of Patent: Feb. 28, 1995

[54] TRASH SEPARATION RECEPTACLE

[76] Inventor: Jerome S. Hanson, 2212 N. St., San Angelo, Tex. 76901

[21] Appl. No.: 144,407

[22] Filed: Nov. 2, 1993

[51] Int. Cl.[6] ..... B65F 1/06; B65F 1/08

[52] U.S. Cl. ..... 220/404; 220/909; 220/410; 220/23.4

[58] Field of Search ..... 220/909, 908, 403, 404, 220/408, 410, 23.83, 23.86, 62, 23.4

[56] References Cited

U.S. PATENT DOCUMENTS

| | | | |
|---|---|---|---|
| 1,281,587 | 10/1918 | Kovachevich | 220/909 |
| 2,736,454 | 2/1956 | McConnell | 220/909 |
| 2,764,461 | 9/1956 | Montgomery | 220/62 |
| 3,219,179 | 11/1965 | Tuccio | 220/62 |
| 4,593,615 | 6/1986 | Kehl | 100/227 |
| 4,729,489 | 3/1988 | Papaianni | 220/23.8 |
| 4,821,903 | 4/1989 | Hayes | 220/23.4 |
| 4,834,262 | 5/1989 | Reed | 220/404 |
| 4,867,328 | 9/1989 | McCarthy | 220/1 T |
| 4,913,308 | 4/1990 | Culbertson | 220/404 |
| 4,955,495 | 9/1990 | Ruebesam | 220/545 |
| 4,991,737 | 2/1991 | Edelman | 220/909 |

*Primary Examiner*—S. Castellano
*Attorney, Agent, or Firm*—Richard L. Miller

[57] ABSTRACT

A trash separation receptacle is provided which consists of a generally rectangular rear panel, with two side panels, each extending from the rear panel. A generally rectangular bottom panel extends from the rear panel. A generally rectangular front panel extends between the two side panels, so as to hold a plurality of trash cans stationary in a side by side relationship. Each trash can may hold a plastic liner bag therein to retain one type of recyclable trash for disposal. A plurality of lids are also provided with each hinged at one side to a top edge of the rear panel, so as to cover one of the trash cans with the plastic liner bag therein.

4 Claims, 1 Drawing Sheet

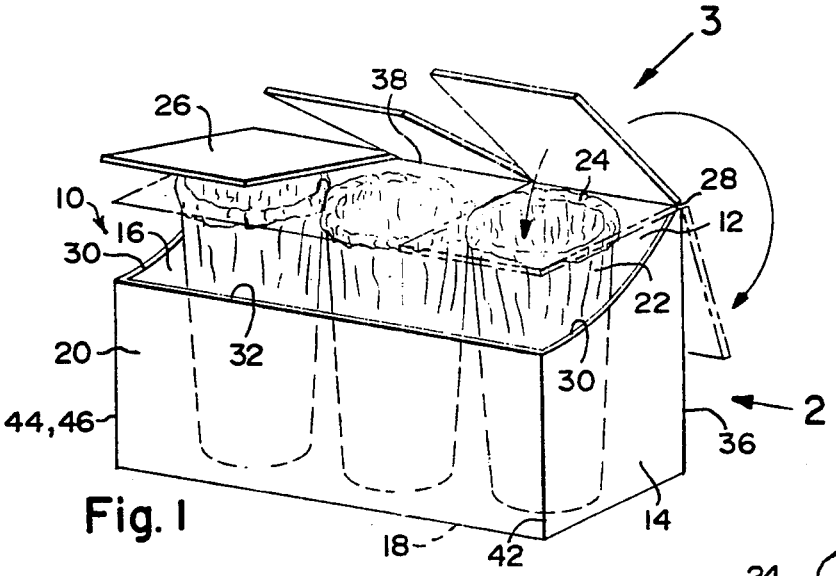
Fig. 1
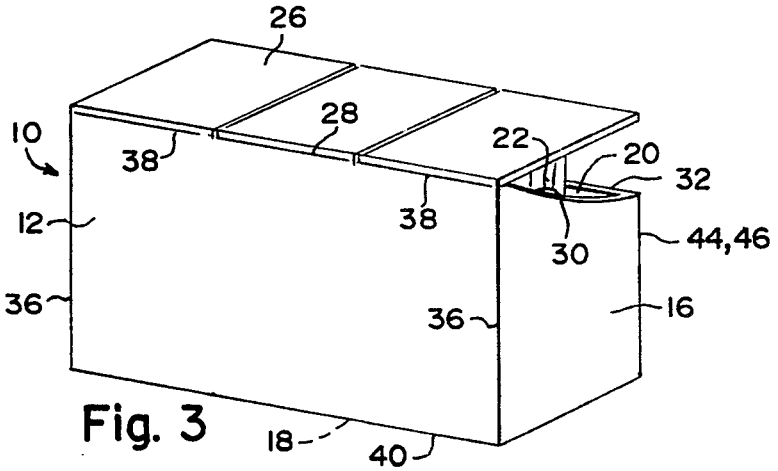
Fig. 3
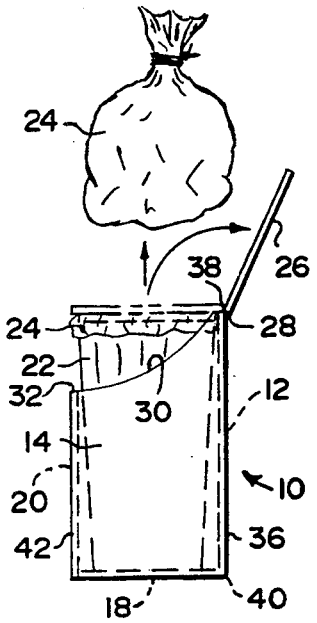
Fig. 2
Fig. 5
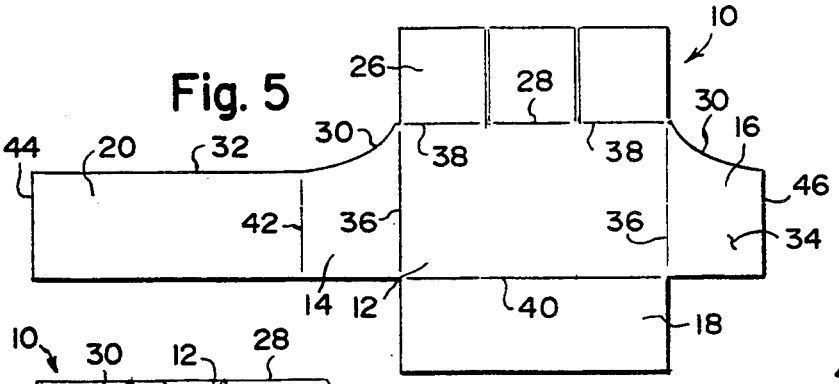
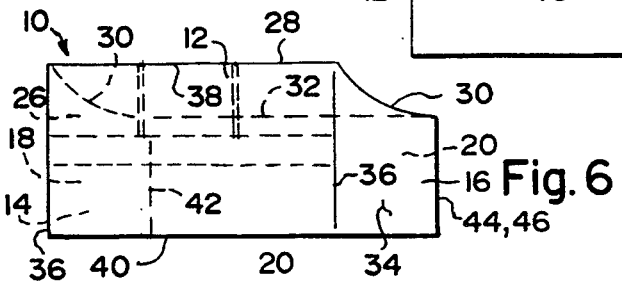
Fig. 6
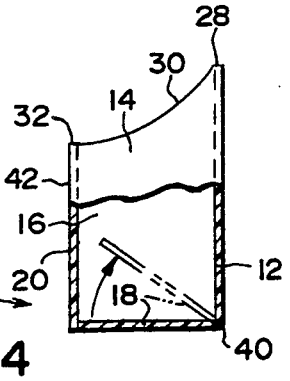
Fig. 4

TRASH SEPARATION RECEPTACLE

BACKGROUND OF THE INVENTION

The instant invention relates generally to waste containers and more specifically it relates to a trash separation receptacle. Numerous waste containers have been provided in prior art that are adapted to receive refuse material, so that the refuse material can be disposed of. For example, U.S. Pat. Nos. 4,593,615 to Kehl; 4,834,262 to Reed; 4,729,489 to Papaianni; 4,867,328 to McCarthy; 4,913,308 to Culbertson and 4,955,495 to Ruebesam all are illustrative of such prior art. While these units may be suitable for the particular purpose to which they address, they would not be as suitable for the purposes of the present invention as heretofore described.

SUMMARY OF THE INVENTION

A primary object of the present invention is to provide a trash separation receptacle that will overcome the shortcomings of the prior art devices.

Another object is to provide a trash separation receptacle that will hold a plurality of trash cans in a side by side relationship, in which each trash can will hold one type of recyclable trash therein.

An additional object is to provide a trash separation receptacle that is collapsible, so as to utilize a minimum of space for storage when not being used.

A further object is to provide a trash separation receptacle that is simple and easy to use.

A still further object is to provide a trash separation receptacle that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

The Figures on the drawings are briefly described as follows:

FIG. 1 is a diagrammatic front perspective view illustrating the instant invention in use with trash cans typically stored therein;

FIG. 2 is a diagrammatic elevational end view taken in the direction of arrow 2 in FIG. 3;

FIG. 3 is a diagrammatic rear perspective view taken generally in the direction of arrow 3 in FIG. 2;

FIG. 4 is a diagrammatic elevational end view similar to FIG. 2 partially in section with parts broken away, illustrating some internal construction features thereof;

FIG. 5 is a diagrammatic flat pattern of the instant invention; and

FIG. 6 is a diagrammatic view illustrating the instant invention in a collapsed state.

DETAILED DESCRIPTION OF THE PREFERRED EMBODIMENTS

Turning now descriptively to the drawings, in which similar reference characters denote similar elements throughout the several views, FIGS. 1 through 4 illustrate a trash separation receptacle 10, which consists of a generally rectangular rear panel 12, with two side panels 14, 16, each extending from the rear panel 12. A generally rectangular bottom panel 18 extends from the rear panel. A generally rectangular front panel 20 extends between the two side panels 14, 16, so as to hold a plurality of trash cans 22 stationary in a side by side relationship. Each trash can 22 will hold a plastic liner bag 24 therein to retain one type of recyclable trash for disposal.

A plurality of lids 26 are also provided, with each hinged at one side to a top edge 28 of the rear panel 12, so as to cover one of the trash cans 22 with the plastic liner bag 24 therein. The front panel 20 is shorter in height than the rear panel 12. Each of the side panels 14, 16 has a downwardly extending curved top edge 30 between the top edge 28 of the rear panel 12 and a top edge 32 of the front panel 20. The upper portions of the trash cans 22 with the plastic liner bags 24 therein will be exposed under the lids 26, to allow for easy removal of the plastic liner bags 24 and the trash cans 22 therefrom.

The trash separation receptacle 10, as best seen in FIGS. 5 and 6, is fabricated out of a single sheet of durable plastic material 34. Each side panel 14, 16 is foldable along a side edge 36, to the rear panel 12. Each lid 26 is foldable along the rear edge 38 to the rear panel 12, so as to form the hinge thereto. The bottom panel 18 is foldable along one edge 40 of the rear panel 12. The front panel 20 is foldable along a first side edge 42 to the first side panel 14. A second side edge 44 is attachable to and foldable along a second side edge 46 of the second side panel 16. Edges 44 and 46 may be permanently attached at the time of manufacture by adhesive or other suitable securement mechanism, or by the end user and is a matter of design choice. The lids 26 can be folded down, the bottom panel 18 folded up and the side panels 14, 16 collapsed to allow the rear panel 12 to close flat against the front panel 20, to utilize a minimum of space for storage when not being used.

OPERATION OF THE INVENTION

To use the trash separation receptacle 10 when in the collapsed state, as shown in FIG. 6, a person simply presses the side panels 14, 16, so that the front panel 20 moves away from the rear panel 12. The bottom panel 18 is then pulled down and the lids 26 are pulled up. The trash cans 22 can be placed into the receptacle 10 in side by side relationships. Trash liner bags 24 can then be inserted into the trash cans 22 and the lids closed over.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A trash separation receptacle which comprises:

a) a generally rectangular rear panel;

b) two side panels, each extending from said rear panel;

c) a generally rectangular bottom panel extending from said rear panel;

d) a generally rectangular front panel shorter in height than said rear panel and extending between said two side panels;

e) a plurality of trash cans, held stationary by the panels, in a side by side relationship and each having a height between a height of the front panel and a height of the rear panel, an upwardly opening mouth and a plastic liner bag therein, so as to retain one type of recyclable trash for disposal; and, f) a plurality of lids each hinged at one side to a top edge of said rear panel, for pivotal movement between open, raised, and closed, lowered positions, respectively, to expose the mouth of the trash can held in thereby for deposit of trash therein and to engage the trash can mouth in covering relation therewith with the plastic liner bag therein.

2. A trash separation receptacle as recited in claim 1, further including:

each of said side panels having a downward extending top edge between the top edge of said rear panel and a top edge of said front panel, so that upper portions of the trash cans will be exposed under said lids, to allow for easy removal of the plastic liner bags and the trash cans thereof adjacent the respective side panels.

3. A trash separation receptacle as recited in claim 2, being fabricated out of a single sheet of durable plastic material and including:

a) each said side panel foldable along a side edge to said rear panel;

b) each said lid foldable along a rear edge to said rear panel, so as to form said hinge thereto;

c) said bottom panel foldable along one edge of said rear panel; and d) said front panel foldable along a first side edge to said first side panel and a second side edge attachable to and foldable along said second side panel, so that subsequent to use of the trash separation receptacle and removal of all trash cans, said lids can be folded down, said bottom panel folded up and said side panels collapsed, to allow said rear panel to close flat against said front panel to utilize a minimum of space for storage when not being used.

4. A trash separation receptacle as recited in claim 1, wherein the height of each trash can is substantially equal to the height of the rear wall.

* * * * *